United States Patent [19]

Kunii

[11] Patent Number: 4,565,264

[45] Date of Patent: Jan. 21, 1986

[54] ELEVATOR SYSTEM

[75] Inventor: Kazushi Kunii, Aichi, Japan

[73] Assignee: Mitsubishi Denki Kabushiki Kaisha, Tokyo, Japan

[21] Appl. No.: 452,051

[22] Filed: Dec. 22, 1982

[30] Foreign Application Priority Data

Jan. 7, 1982 [JP] Japan ..... 57-1292

[51] Int. Cl.[4] ..... B66B 5/16

[52] U.S. Cl. ..... 187/89; 188/189

[58] Field of Search ..... 187/89, 90, 77, 79, 187/80, 81–84, 85, 86; 188/188, 189

[56] References Cited

U.S. PATENT DOCUMENTS

| | | | |
|---|---|---|---|
| 601,535 | 3/1898 | Taylor | 187/89 |
| 2,266,915 | 12/1941 | Steedman | 187/89 |
| 2,274,000 | 2/1942 | Sahlin | 187/90 |
| 2,298,167 | 10/1942 | Rissler | 187/90 |
| 2,581,297 | 1/1952 | Rissler | 187/83 |

FOREIGN PATENT DOCUMENTS

| | | |
|---|---|---|
| 47-42763 | 10/1972 | Japan . |
| 47-37781 | 11/1972 | Japan . |

*Primary Examiner*—Joseph J. Rolla
*Assistant Examiner*—Kenneth Noland
*Attorney, Agent, or Firm*—Wenderoth, Lind & Ponack

[57] ABSTRACT

An elevator system wherein installed within the elevator shaft are a governor and a guide wheel at the lower and upper portions, respectively, a governor wire rope extending therebetween to which is connected an actuation mechanism for a safety device of the cage, and structure for tensioning the governor wire rope is arranged in the non-operating part thereof extending between the connecting part of the rope to the actuation mechanism and the governor the tensioning structure includes a spring to give a simplified constitution and allow the governor wire rope to be disposed within a narrow space. Disposed at the connecting portion of the governor wire rope to the actuation mechanism is a vibration absorbing mechanism so that the actuation of the safety device due to vibration of the cage is prevented.

20 Claims, 5 Drawing Figures

ELEVATOR SYSTEM

BACKGROUND OF THE INVENTION

1. Field of the Invention

The present invention relates to an elevator system and more particularly to an improvement in a governor apparatus for stopping an elevator system in case of emergency.

2. Description of the Prior Art

Hitherto, governors for elevator systems which in case of overspeed of the elevator cage act to detect the overspeed and grasp a governor wire rope have been installed at the upper part of the hoist way, but it is often the case in the building in which an elevator system is to be installed that a machine room for installing a governor cannot be provided directly above the elevator shaft, or, even if such a machine room can be provided, an entrance, opening, or the like to allow entrance into the room cannot be provided.

In order to remedy such difficulties, various countermeasures have been already proposed. For example, Japanese Utility Model Publication No. 37781/1972 (published on Nov. 15, 1972) proposes, as shown in FIG. 3, to install a governor at the lower portion of an elevator shaft, and Japanese Patent Publication No. 42763/1972 (published on Oct. 28, 1972) proposes, as shown in FIGS. 3, 5 and 12 thereof, installing a governor at the lower portion of the elevator shaft.

However, in those inventions, means for tensioning the governor wire rope are complicated, large in size, etc., and otherwise not fully satisfactory. That is, in the first invention mentioned above, as a tensioning device a number of elements are required such as a tension wheel, a weight, an L-shaped arm rotatably supported by a bracket, a lower guide wheel, etc., and also in the second invention mentioned above, a chain, a sprocket wheel with lock means, a weight, or a weight with lock means, etc. are required.

SUMMARY OF THE INVENTION

It is an object of the present invention to provide a governor apparatus for an elevator system in which the means for tensioning the governor wire rope are improved so as to have a simple constitution.

It is another object of the present invention to provide an elevator system wherein a governor is provided in the lower part of the elevator shaft and a governor wire rope can be maintained in tension by the use of a device of simple constitution.

It is a further object of the present invention to provide an elevator system in which a governor apparatus is not actuated by larger than normal but not dangerous oscillation of the cage.

In accordance with the present invention an elevator system is provided in which a governor and a guide wheel are respectively provided at the top and the bottom of the elevator shaft, a governor wire rope connected at one end to an actuating mechanism for a safety device of the cage being reeved on the guide wheel and then reeved on the governor, and the other end of the governor wire rope is connected to one end of a tensioning means, the other end of the tensioning means being connected to the actuating mechanism to give tension to the governor wire rope. Thus, at the time of the actuation of the governor the safety device can be operated through the tensioning means and the actuating mechanism. Further, with this construction, even if the governor is installed at the lower portion of the elevator shaft, an emergency halt operation can be effected whenever necessary with a device of simple and low cost construction, allowing the governor and the governor wire rope to be installed within a narrow space.

In one aspect of the present invention a vibration absorption mechanism is provided at the connecting point between the governor wire rope and the actuating mechanism, preventing the undesired actuation of the safety device due to vibrations of the cage.

BRIEF DESCRIPTION OF THE DRAWINGS

Other objects of the present invention will become readily apparent upon study of the following detailed description and the appended drawings, in which.

DESCRIPTION OF THE PREFERRED EMBODIMENTS

Figure 1:
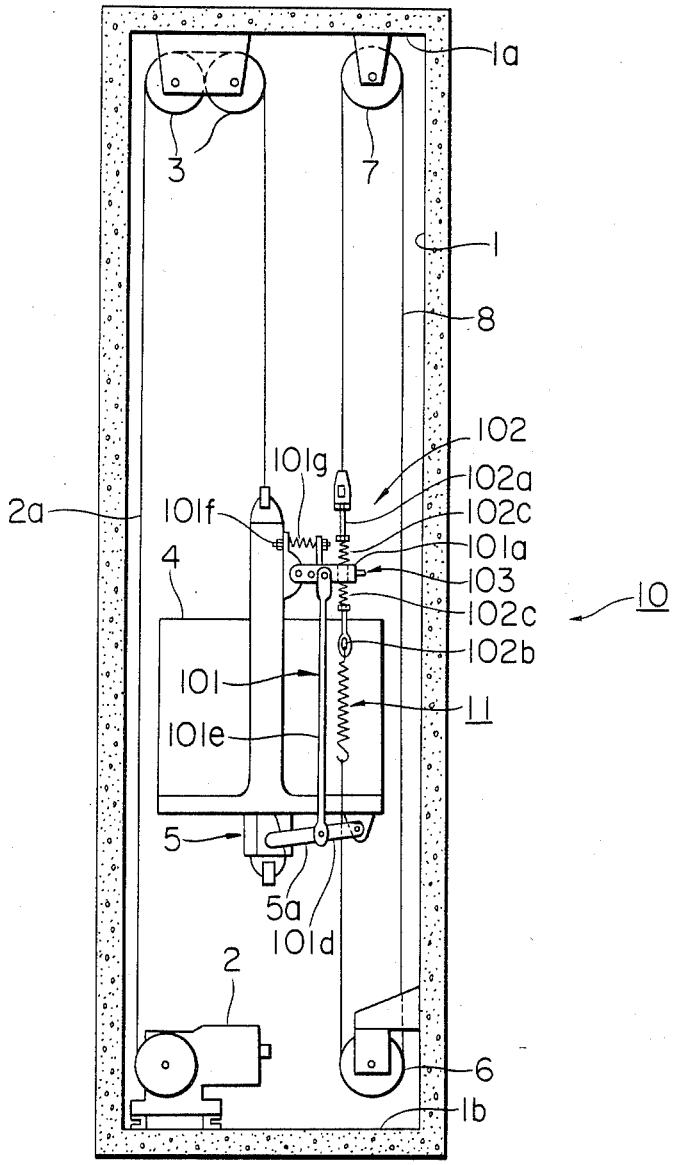
FIG. 1 is a diagrammatical vertical sectional view of a first embodiment of the present invention.

Now an embodiment of the present invention will be explained with reference to FIG. 1 of the attached drawings.

In the drawing, the reference numeral 1 designates the elevator shaft of an elevator system, having an upper part 1*a* and a lower part 1*b*. A traction machine 2 is mounted within lower part 1*b*. A hoisting wire rope 2*a* is suspended on suspension wheels for wire rope 2*a* which wheels are rotatably attached to upper part 1*a*. An elevator cage 4 is suspended from wire rope 2*a* through suspension wheels 3. A publicly known safety device 5 is provided on cage 4, 4 having an operating mechanism 5*a*. A governor 6 is mounted at the lower part 1*b* of elevator shaft 1. A guide wheel 7 rotatably secured to the upper part 1*a* of hoist way 1. An actuation mechanism 10 is provided for safety device 5. Reference Numeral 101 designates a transmission device constituting a part of actuation mechanism Reference Numeral 101*a* designates a first lever constituting, as shown in FIG. 2, a part of transmission device 101 which is pivotably attached at one end to the frame of cage 4 and has a through hole 101*b* at its other end oriented transversely to the axial direction of the first lever 101*a*. A protrusion 101*c* projects upwards from the mid portion of first lever 101*a*. As shown in FIG. 1, a second lever 101*d* is pivotally mounted at one end to the bottom of the frame of cage 4 and holds at the other end the brake member (not shown) of safety device 5. A rod 101*e* is pivotably connected at its ends to the mid portions of first lever 101*a* and second lever 101*d*, respectively. A bolt 101*f* passes loosely through the upper part of protrusion 101*c* and is rigidly secured to the cage 4 with the head abutting against protrusion 101*c* and the opposite end being secured by a nut. A holding spring 101*g* is formed of a compression spring loosely disposed around bolt 101*f* between cage 4 and protrusion 101*c*. A vibration absorbing mechanism 102 is mounted to the free end portion of first lever. As is shown in FIG. 2, a connecting rod 102*a* constitutes a part of vibration absorbing mechanism 102 which is connected at its upper end with one end of governor wire rope 8 and loosely passes through through hole 101*b* of first lever 101*a*, the lower end of connecting rod 102*a* being formed with a connecting hole 102*b*. Vibration absorbing springs 102*c*, each comprising a compression spring, are loosely disposed around connecting rod 102*a* so as to be positioned above and below first lever 101*a*, respectively, and kept compressed by screwing nuts 102*d* to the upper and lower portions of connecting rod 102*a*, respectively. A friction damping mechanism 103 is mounted to first lever 101*a* of transmission device 101. A first shifting member 103*a* is loosely fit within a bore 103*b* longitudinally formed in first lever 101*a* so as to be in communication with through hole 101*b* and opened at the free end of lever 101*a*. A second shifting member 103*c* is disposed between the wall of through hole 101*b* and the outer periphery of connecting rod 102*a* so as to confront first shifting member 103*a*. A pusher plug 103*d* is screwed into bore 103*b* from the free open end of first lever 101*a*. A pusher spring 103*e* comprising a compression spring is received within bore 103*b* and disposed between first shifting member 103*a* and pusher plug 103*d*. Reference numeral 11 designates a tension device comprising a tension coil spring. Governor wire rope 8, as shown in FIG. 1, connected at one end to the upper end of connecting rod 102*a*, extends upwards, is reeved around guide wheel 7, and then extends downwards to be reeved around governor 6. The governor 6 is thereby actuated, and so the portion of governor wire rope 8 described so far will be hereafter referred to as the wire rope actuating part. The remaining portion of governor wire rope 8 then extends upwards from governor 6 and is connected to tension device 11, this latter portion of governor wire rope 8 between the governor 6 and the tension device 11 being hereafter referred to as the wire rope non-actuating part.

The embodiment of the present invention described herein and shown in FIGS. 1 and 2 operates as follows.

Governor wire rope 8 which is kept under tension by tension device 11 is held by cage 4 through vibration absorbing mechanism 102 and transmission device 101, i.e. actuation mechanism 10, so that governor 6 is operated as cage 4 moves up and down. Transmission device 101 is maintained in a non-operating condition by holding spring 101*g* so that transmission device 101 is not brought into operation during normal acceleration of cage 4. However, when cage 4 descends at a speed exceeding a predetermined velocity, governor wire rope 8 is constrained by governor 6 upon its detection of such an overspeed. This constraining force is applied to actuation mechanism 10 independently of tension device 11 so that safety device 5 is operated through the operation of actuation mechanism 10 alone.

Since tension device 11 is positioned below the elevator cage, in the non-actuating part of the wire rope 8, it is not tensioned when the governor 6 activates and tensions the actuating part of the wire rope 8. This location of the tension device has two advantages. One is that it is not subject to damage due to the great tension which would be applied to it were it located above the elevator in the actuating part of the wire rope 8. Another is that, if it were located in the actuating part, it would be stretched to its full length by the tension applied to governor rope 8 before it would actuate the safety device 5. The time required to stretch the tension device 11 would create a time delay between the tensioning of the wire rope 8 by the governor 6 and the actuation of safety device 5. With the tensioning device 11 in the non-actuating part of the wire rope, however, tension applied to the wire rope 8 by the governor 6 can immediately activate the safety device 5 with no time delay. Further, in order that transmission device 101 and safety device 5 are not erroneously actuated by a larger than usual but not dangerous oscillation of cage 4 due to, for example, jumping of the passengers within the cage 4, such larger than usual oscillations can be absorbed by vibration absorbing mechanism 102. Friction damping mechanism 103 operates to damp the oscillations so that the erroneous actuation of safety device 5 is prevented.

Now the manner in which such an erroneous actuation is prevented will be explained more precisely with reference to FIG. 2. When cage 4 is accelerated upwards, inertial force exerts a clockwise torque on first lever 101*a*, as viewed in FIG. 2, but since protrusion 101*c* abuts against the head of bolt 101*f*, the clockwise rotation of first lever 101*a* is prevented. Therefore, as cage 4 rises first lever 101*a* does not rotate, and rod 101*e* does not move, either. Accordingly, actuation mechanism 10 does not operate, and safety device 5 is not actuated.

Alternatively, when cage 4 accelerates downwards or oscillates downwards, first lever 101*a* tends to rotate in the counterclockwise direction as viewed in FIG. 2, but the rotation of first lever 101*a* in the counterclockwise direction is constrained due to the force applied to protrusion 101*c* in the clockwise direction by spring 101*g* as well as the force applied to first lever 101*a* to hold it at an intermediate position by springs 102*c*, and the frictional force generated between grasping governor wire rope 8 and first and second shifting members 103*a*, 103*c* by spring 103*e*, etc. Therefore, rod 101*e* and actuation mechanism 10 do not move much during normal acceleration and oscillation of cage 4 in the downwards direction so that safety device 5 is not erroneously actuated.

Therefore, in spite of the fact that, in the present invention, governor 6 is mounted at the lower part 1*b* of elevator shaft 1 with vibration absorbing mechanism 102 and friction damping mechanism 103 being associated therewith, the present invention allows cage 4 to effect an emergency stopping operation whenever necessary using an apparatus of simple construction.

It will be apparent that when this embodiment is applied to a fluid pressure actuated elevator, a similar operation will be revealed.

Figure 2:
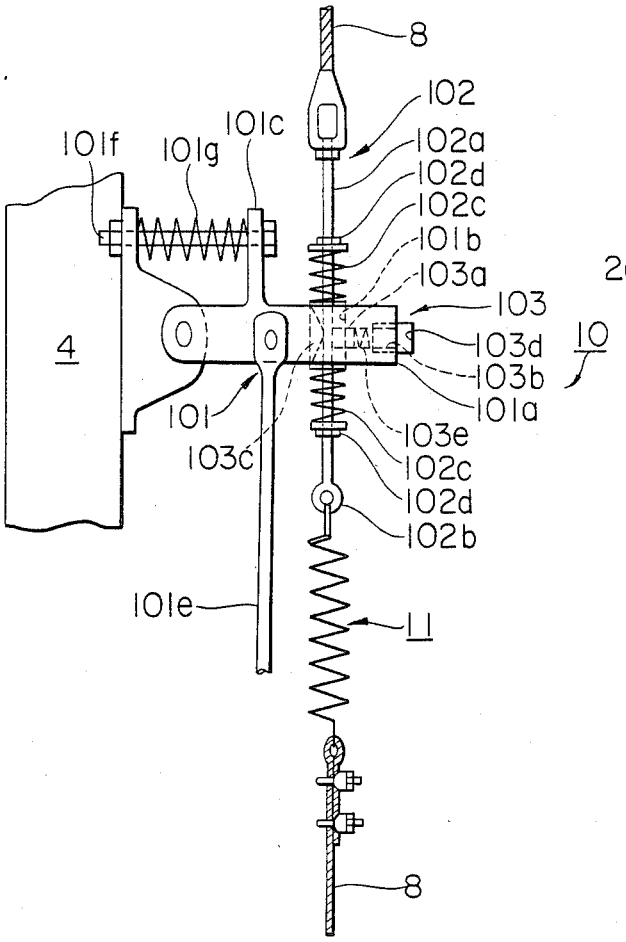
FIG. 2 is an enlarged view of the principal part of FIG. 2.
Figure 3:
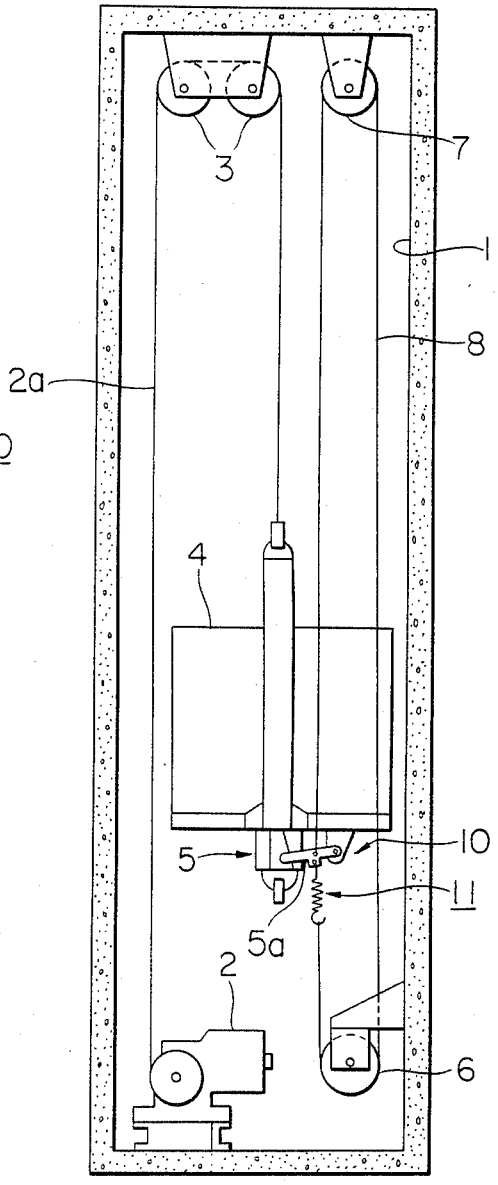
FIG. 3 is a diagrammatical vertical view of a second embodiment of the present invention.

FIG. 3 shows another embodiment of the present invention wherein the same reference numerals as those in FIGS. 1 and 2 indicate equivalent parts, reference numeral 10 designates an actuation mechanism comprising a lever which is pivotally connected at one end to cage 4 and holds at the other end a brake member (not shown) of safety device 5 similar to that in the previous embodiment. As is apparent from FIG. 3, in this embodiment a governor wire rope 8, one end of which is connected to actuation mechanism 10, extends upwards to be wound around guide wheel 7 and thence extends downwards to be wound around governor 8, the other end extending upwards and being connected to actuation mechanism 10 through tension device 11.

Although a detailed explanation is omitted, it will be apparent that this embodiment operates similarly to the embodiment shown in FIGS. 1 and 2.

Figure 4:
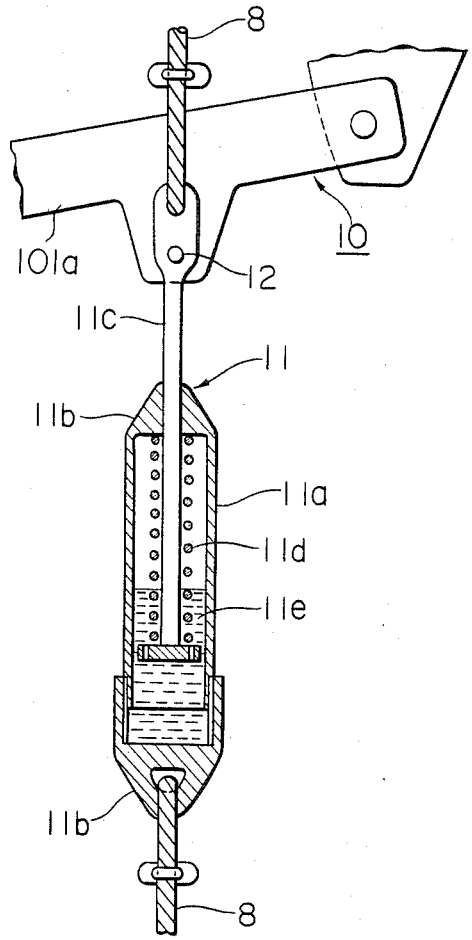
FIG. 4 is a partial sectional view of a third embodiment of the present invention on a larger scale, corresponding to the principal portion of FIG. 2.

FIG. 4 shows a further embodiment of the present invention wherein the same reference numerals as those in FIG. 2 indicate equivalent parts. The reference numeral 11*a* designates a cylinder constituting a tension device 11, having tapered portions 11*b* formed at the upper and lower end positions thereof. A piston rod 11*c* projects from cylinder 11*a* an energizing element 11*d* comprising a compression coil spring is disposed around piston 11*c* and arranged between the lower end of piston rod 11*c* and the upper inner end of cylinder 11*a*. An operating fluid 11*e* is contained within cylinder 11*a*. A pin 12 connects the upper end of piston rod 11*c* with actuation mechanism 10. A governor wire rope 8 is connected at its extreme ends to the upper end of piston rod 11*c* and the lower end of cylinder 11*a*, respectively.

The operation of this embodiment is as follows.

Governor wire rope 8, which is adapted to be tensioned by energizing element 11*d*, is connected at one end to the top end of tension device 11 through actuation mechanism 10 and then extends upwards. After reeving around guide wheel 7, rope 8 descends to be reeved around governor 6, and the other end of rope 8 rises upwards and is connected to the lower end of tension device 11. Thus, although a detailed explanation is omitted, it will be apparent that an operation similar to that in the first and second embodiments is also produced in this embodiment. In this embodiment the following additional operation can be obtained. Since energizing element 11*d* comprises a compression coil spring, if the governor rope should happen to catch on and be momentarily constrained from moving by some structure protruding from the sides of elevator shaft 1, such as a structural beam, governor wire rope 8 is not broken because of full compression of energizing element 11*d*. Further, since tension device 11 comprises an oil damper means the oscillation of actuation mechanism 10, etc. caused when cage 4 is accelerated or decelerated can be suppressed. Moreover, tapered portions 11*b* of cylinder 11*a* serve to prevent cylinder 11*a* from catching on any structures mounted in elevator shaft 1.

Figure 5:
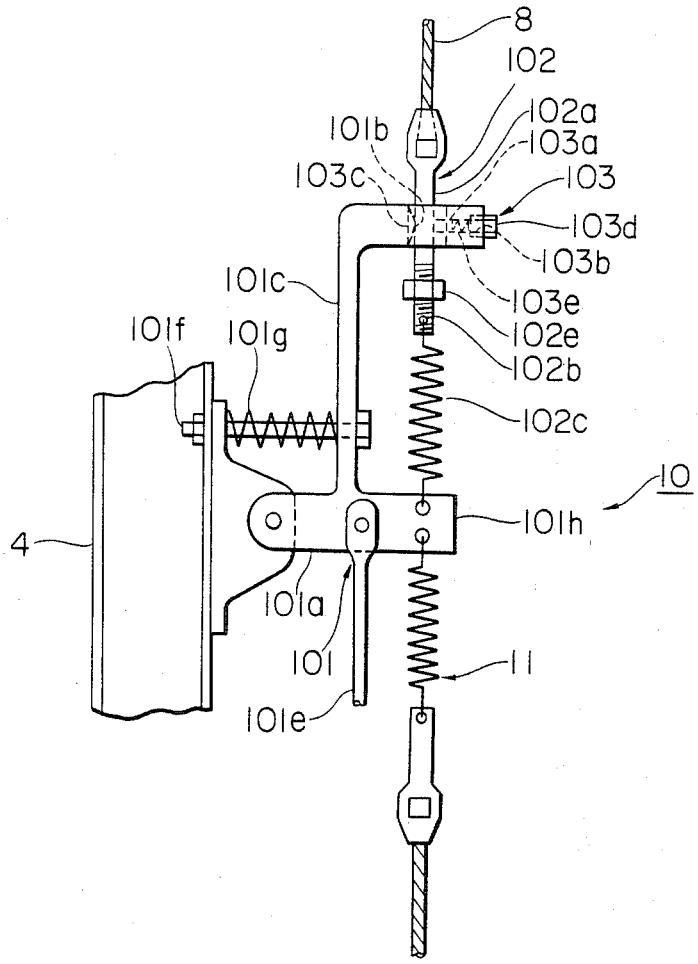
FIG. 5 is a partial sectional view of a fourth embodiment of the present invention on a larger scale.

Finally, FIG. 5 shows a still further embodiment of the present invention in which the first lever has a twin legged construction. In the drawing the element similar to those shown in FIG. 2 bear similar reference numerals. The first lever 101*a* is pivotably connected at one end to cage 4 and formed at the other end with a solid end 101*h*. Protruding upwards at the mid portion is a bent protrusion 101*c*. A through hole 101*b* is formed at the end portion in the horizontal portion of protrusion 101*c*. A vibration absorbing mechanism 102 is mounted to the horizontal portion of protrusion 101*c*. A vibration absorbing spring 102*c* comprising a coil spring is connected at one end to a connecting hole 102*b* of a connecting rod 102*a* and engaged at the other end by a portion of solid end 101*h* of first lever 101*a*. A stopper 102*e* comprising a nut is screwed onto the lower end portion of connecting rod 102*a*. A tensioning means 11 disposed beneath first lever 101*a* and comprising a coil spring is engaged at one end by a portion of solid end 101*h* of first lever 101*a*, the other end of which connects to governor wire rope 8. Tensioning means 11 simultaneously serves as a vibration absorbing spring of vibration absorbing mechanism 102.

Thus, in this embodiment governor wire rope 8 which is tensioned by tensioning means 11 is connected to cage 4 through vibration absorbing mechanism 102 and friction damping mechanism 103. Therefore, although a detailed explanation is omitted, it is apparent that also in this embodiment an operation similar to that in the embodiments shown in FIGS. 2 and 3 is obtainable. Further, in this embodiment, since tensioning means 11 and vibration absorbing mechanism 102 share one vibration absorption spring, i.e. spring 102*c*, the desired operation will be realized by the use of fewer parts.

Although a few preferred embodiments of the present invention have been described and illustrated, it will be understood by those skilled in the art that modifications may be made in the structure, form and relative arrangement of parts without necessarily departing from the spirit and the scope of the present invention.

What is claimed is:

1. An elevator apparatus for bringing an elevator cage in an elevator shaft to an emergency stop when the speed of descent of the elevator cage exceeds a predetermined rate, comprising:

a governor wire rope;

a governor mounted to a lower portion of the elevator shaft, said governor wire rope being reeved over said governor, said governor having means operative in response to vertical movement of said governor wire rope for detecting the speed of the cage and for grasping the governor wire rope when an abnormal ascending or descending speed is detected;

a guide wheel rotatably mounted to an upper portion of the elevator shaft above the lower portion;

a safety device for being mounted on the cage, including means for bringing the cage to an emergency stop when the descending speed of the cage exceeds said predetermined rate;

means, including an actuation mechanism coupled to said safety device, for actuating said safety device to bring the cage to an emergency stop;

said governor wire rope having first and second free ends and being located in the elevator shaft reeved over said guide wheel and said governor, said rope being connected at said first free end to said actuation mechanism so as to move with the cage to operate said governor, said governor wire rope being adapted to be grasped by said governor to be stopped when said governor detects a speed in excess of said abnormal speed; and a tensioning means, disposed between said second free end of said governor wire rope and said actuation mechanism, for connecting said second free end and said actuation mechanism together and for tensioning said governor wire rope.

2. An elevator apparatus as in claim 1 wherein said tensioning means comprises a coil spring which fixedly connects said governor wire rope and said actuation mechanism.

3. An elevator apparatus as in claim 2, wherein said governor wire rope has an actuating part and a non-actuating part respectively extending from opposite sides of said governor to said first and second free ends of said governor wire rope, whereby said coil spring is connected to said governor wire rope at said non-actuating part so as not to be tensioned when said governor grasps said governor wire rope to tension said actuating part of said governor wire rope.

4. An elevator apparatus as in claim 1, wherein said first free end of said governor wire rope and said actuation mechanism are connected together through friction damping means.

5. An elevator apparatus as in claim 4, wherein said friction damping means comprise a first and a second shifter element having said governor wire rope passing therebetween, and also comprise elastic means for causing said shifter elements to frictionally engage said governor wire rope.

6. An elevator apparatus as in claim 4, wherein said actuation mechanism includes a first member having a void, said friction damping means being located within said void so as to be directly connected to said governor wire rope.

7. An elevator system as in claim 1, wherein said actuation mechanism includes a third member which moves during operation of said actuating mechanism, directly connected to said governor wire rope, and means for elastically applying a constraining force thereto to constrain movement of said third member and thereby constrain operation of said actuating mechanism.

8. An elevator apparatus as in claim 7, wherein said third member is formed with a protrusion said elastically applying means including a spring elastically which abuts said protrusion so as to apply said constraining force to said third member.

9. An elevator apparatus as in claim 1, further comprising a connecting part connecting said first free end of said governor wire rope and said actuation mechanism, and a vibration absorbing mechanism for absorbing vibration of said cage, disposed within said connecting part.

10. An elevator apparatus as in claim 23, wherein said actuation mechanism includes a second member directly connected to said governor wire rope, said vibration absorbing mechanism including means, including springs, for elastically constraining the motion of said second member in the direction parallel to said governor rope so as to absorb forces tending to move said second member in said direction.

11. An elevator apparatus as in claim 10, wherein said springs comprise a set of springs disposed above and below said second member elastically holding said second member.

12. An elevator apparatus as claimed in claim 11, wherein said governor wire rope has an actuating part and a non-actuating part respectively extending from opposite sides of said governor to said first and second free ends of said governor wire rope, and wherein one spring of said set of springs is connected to said non-actuating part of said governor wire rope so as to tension said governor wire rope, said one spring forming said tensioning means.

13. An elevator apparatus for bringing an elevator cage in an elevator shaft to an emergency stop when the speed of descent of the elevator cage exceeds a predetermined rate, comprising:

a governor wire rope;

a governor mounted to a lower portion of the shaft, said governor wire rope being reeved over said governor, said governor having means operative in response to vertical movement of said governor wire rope, for detecting the speed of the cage and for grasping the governor wire rope when an abnormal ascending or descending speed is detected;

a guide wheel rotatably mounted to an upper portion of the elevator shaft above the lower portion;

a safety device for being mounted on the cage, including means for bringing the cage to an emergency stop when the descending speed of the cage exceeds said predetermined rate;

means, including a actuation mechanism coupled to said safety device for actuating said safety device to bring the cage to an emergency stop;

said governor wire rope located in the elevator shaft reeved over said guide wheel and said governor, said rope being connected at one end to said actuation mechanism so as to move with the cage to operate said governor, said governor wire rope being adapted to be grasped by said governor to be stopped when said governor detects a speed in excess of said abnormal speed;

means for frictionally damping relative movement of said governor wire rope and said cage, connecting said one end of said governor wire rope and said actuation mechanism; and a tensioning means, disposed between the other end of said governor wire rope and said actuation mechanism, for connecting said other end and said actuation mechanism together and for tensioning said governor wire rope.

14. An elevator apparatus for bringing an elevator cage in an elevator shaft to an emergency stop when the speed of descent of the elevator cage exceeds a predetermined rate, comprising:

a governor wire rope;

a governor mounted to a lower portion of the shaft, said governor wire rope being reeved over said governor, said governor having means, operative in response to vertical movement of said governor wire rope, for detecting the speed of the cage and for grasping the governor wire rope when an abnormal ascending or descending speed is detected;

a guide wheel rotatably mounted to an upper portion of the elevator shaft above the lower portion;

a safety device for being mounted on the cage, including means for bringing the cage to an emergency stop when the descending speed of the cage exceeds said predetermined rate;

means, including an actuation mechanism coupled to said safety device, for actuating said safety device to bring the cage to an emergency stop;

said governor wire rope located in the elevator shaft reeved over said guide wheel and said governor, said rope being connected at one end to said actuation mechanism so as to move with the cage to operate said governor, said governor wire rope being adapted to be grasped by said governor to be stopped when said governor detects a speed in excess of said abnormal speed; and a tensioning means, including an oil damper disposed between the other end of said governor wire rope and said actuation mechanism, for connecting said other end and said actuation mechanism together and for tensioning said governor wire rope.

15. An elevator system as in claim 14, wherein said oil damper has tapered ends.

16. An elevator system as in claim 14, wherein said oil damper includes a piston rod having a protruding end connected to said actuating mechanism as well as to said one end of said governor wire rope.

17. An elevator apparatus for bringing an elevator cage in an elevator shaft to an emergency stop when the speed of descent of the elevator cage exceeds a predetermined rate, comprising:

a governor wire rope;

a governor mounted to a lower portion of the elevator shaft, said governor wire rope being reeved over said governor, said governor having means, operative in response to vertical movement of said governor wire rope, for detecting the speed of the cage and for grasping the governor wire rope when a descending speed in excess of said predetermined rate is detected;

a guide wheel rotatably mounted to an upper portion of the elevator shaft above the lower portion;

an emergency stopping device for being mounted on the cage, including means for bringing the cage to an emergency stop when the descending speed of the cage exceeds said predetermined rate;

means, including an actuation mechanism coupled to said emergency stopping device, for actuating said emergency stopping device to bring the cage to an emergency stop;

said governor wire rope located in the elevator shaft reeved over said guide wheel and said governor, said governor wire rope being connected at one end to said actuation mechanism so as to move with the cage to operate said governor, said governor wire rope being adapted to be grasped by said governor to be stopped when said governor detects a speed in excess of said predetermined rate;

a tensioning means, disposed between the other end of said governor wire rope and said actuation mechanism, for connecting said other end and said actuation mechanism together and for tensioning said governor wire rope;

a connecting part connecting said one end of said governor wire rope to said actuation mechanism, said actuation mechanism including a first member;

friction damping means, disposed in said first member, for frictionally engaging said connecting part so as to frictionally damp abnormal vibrations of the cage; and vibration absorbing means, located at said connecting part and said first member, for absorbing vibration forces directed parallel said governor wire rope so as to prevent said actuation mechanism from actuating said emergency stopping device.

18. An elevator apparatus as in claim 17, wherein said first member of said actuation mechanism is formed with a through hole for the passage of said one end of said governor wire rope and with an opening having received therein said friction damping means, said friction damping means including a first and a second shifter element in said opening between which passes said governor wire rope, and a pusher spring and a pusher plug disposed within said opening so as to push said first and second shifter elements into frictional engagement with said governor wire rope, said vibration absorbing means including nuts fixed on with respect to said governor wire rope above and below said first member of said actuation mechanism at predetermined distances from said first member and a vibration absorbing spring disposed between each of said nuts and said member so as to elastically press said mechanism from above and below.

19. An elevator as in claim 17, wherein said first member has two legs, said connecting part of said governor wire rope passing through one of said two legs, said one of said two legs carring said friction damping means, said vibration absorbing means including two vibration absorbing springs connected to the other of said two legs.

20. An elevator apparatus as in claim 19, wherein one of said vibration absorbing springs of said vibration absorbing means is disposed between said other one of said two legs and said governor wire rope acts and forms said tensioning means.

* * * * *